US005924927A

United States Patent [19]

Matsuura et al.

[11] Patent Number: 5,924,927

[45] Date of Patent: Jul. 20, 1999

[54] RACING GAME APPARATUS

[75] Inventors: Kazuhito Matsuura, Tokyo; Isao Uehara, Kanagawa-ken, both of Japan

[73] Assignee: Konami Co., Ltd., Hyogo-ken, Japan

[21] Appl. No.: 08/914,952

[22] Filed: Aug. 20, 1997

[30] Foreign Application Priority Data

Aug. 21, 1996 [JP] Japan ..... 8-220222
Aug. 21, 1996 [JP] Japan ..... 8-220223

[51] Int. Cl.[6] ..... A63H 13/00

[52] U.S. Cl. ..... 463/62

[58] Field of Search ..... 463/58, 59, 60, 463/61, 62, 63, 64, 65, 66, 67, 68, 69

[56] References Cited

U.S. PATENT DOCUMENTS 1,703,378 2/1929 Barnum ..... 463/69
2,751,227 6/1956 Seltzman ..... 463/68
3,297,323 1/1967 Gibson, Jr. ..... 463/59

*Primary Examiner*—William H. Grieb
*Attorney, Agent, or Firm*—Jordan and Hamburg LLP

[57] ABSTRACT

A horse racing game apparatus for simulating horse races has a game board with race courses established thereon and a plurality of simulated racehorses movable along the race courses for ranks. A central field is disposed on the game board and defines an inner circumferential path for the race courses. The central field is selectively extensible and contractable in at least one direction. The horse racing game apparatus also has a start gate for indicating a start position for the race courses. The start gate is disposed so as to be movable along the race courses. The start gate is angularly movable between a first position in which it lies over and across the race courses and a second position in which it is retracted away from the race courses.

20 Claims, 10 Drawing Sheets

RACING GAME APPARATUS

BACKGROUND OF THE INVENTION

1. Field of the Invention

The present invention relates to a racing game apparatus for simulating and playing a variety of races such as horse race, bicycle races, athletic track races, car races, motorcycle races, etc., on a game board which resembles a track.

2. Description of the Prior Art

Heretofore, there have been known racing game apparatus having moving objects resembling racehorses, bicycles, athletes, cars, motorcycles, boats, etc. which run along respective courses on a track-shaped game board to compete for higher ranks under the control of a computer. Game players who participate in racing games played on those racing game apparatus bet points or medals on favorite moving objects. The racing game apparatus are required to be highly analogous to actual races such as horse races so that the game players can play racing games in a virtual-reality environment.

Actual races may be performed on differently arranged race courses. For example, bicycle races are carried out on a plurality of circuits, and bicycle racers compete for series championship based on the results of all the bicycle races. Horse race courses are basically in the form of an oval track. However, in order to provide different race varieties in view of different racehorse characteristics, each of horse races, particularly highly prized horse races, has its own track length (length along the major longitudinal axis), start and goal positions (and hence a combination of straight courses and corners), track condition (turf or dirt), number of times that the track is to be circled (i.e., the total length of the courses), and the direction in which to circle the track (clockwise or counterclockwise). Furthermore, athletic track races are performed for 100 m, 200 m, and 400 m on the same track, and therefore use different track portions, i.e., start and goal positions, on the track.

The racing game apparatus which have been developed and put to use so far have only one race course established on the game board and fixed start and goal positions on the race course. Therefore, it has been impossible with the conventional racing game apparatus to arrange a plurality of different race courses similar to actual race courses.

It may be possible to simply establish a plurality of race courses parallel to each other on a game board or cross and overlap a plurality of race courses on a game board. However, such simply added race courses would make the racing game apparatus too large in scale and too complex, and prevent the racing game apparatus from being installed in a limited space such as a game arcade.

SUMMARY OF THE INVENTION

It is therefore an object of the present invention to provide a racing game apparatus which is relatively small in scale and is capable of arranging a plurality of race courses with a relatively simple structure.

According to the present invention, there is provided a racing game apparatus has a central field defining an inner circumferential path for race courses established on a game board for a plurality of movable bodies to move along for ranks. The central field is selectively extensible and contractable in at least one direction. The central field is mounted on the game board, and is selectively extended and contracted by a mechanism.

The central field may comprise a central fixed member fixed to the game board and a pair of movable members on opposite ends of the central fixed member and movable toward and away from the central fixed member. The mechanism may move the movable members.

The mechanism may comprise a detector, such as a microswitch, for detecting the movable members in each of the predetermined positions and an actuator for moving the movable members until the detector detects the movable members in each of the predetermined positions.

According to the present invention, there is also provided a racing game apparatus comprising a start position indicator for indicating a start position for race courses established on a game board for a plurality of movable bodies to move along for ranks. The start position indicator is disposed so as to be movable along the race courses. The start position indicator is movable along the race courses by a mechanism.

The racing game apparatus may also include a holder for holding the start position indicator for displacement between a first position in which the start position indicator lies over and across the race courses and a second position in which the start position indicator is retracted away from the race courses, and a mechanism for moving the holder along the race courses.

The horse racing game apparatus allows the central field to be selectively extended and contracted in its longitudinal direction to change the inner circumferential path or length of the track, and also allows the start position indicator or start gate to change its position. The racing game apparatus is relatively simple in structure and small in size, but is capable of arranging a wide variety of race course selections.

Since the start position indicator is movable along the race courses, the racing game apparatus can arrange a wide variety of race course selections with a relatively simple structure.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

The present invention is particularly useful when embodied in a racing game apparatus such as a horse racing game apparatus.

Figure 1:
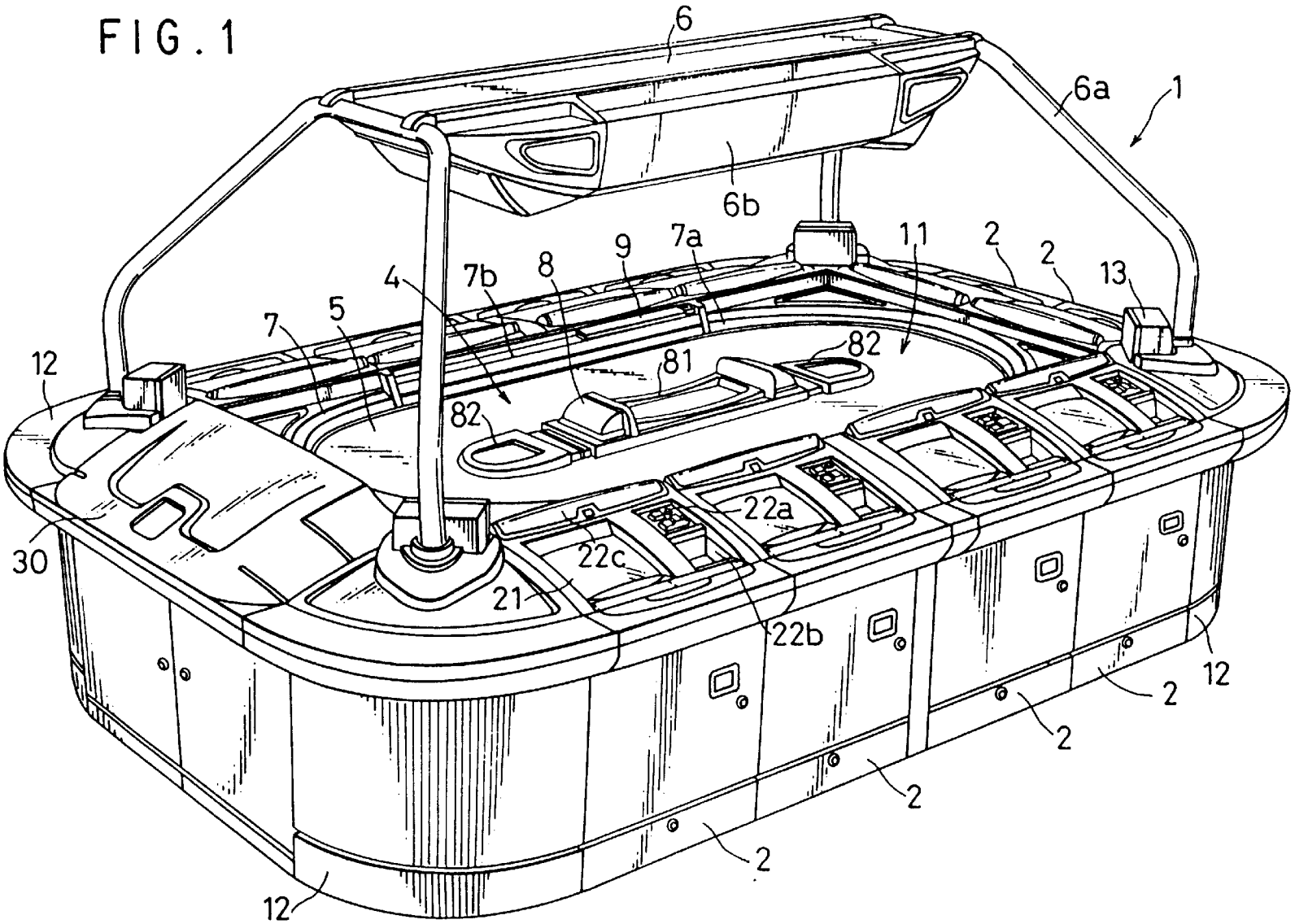
FIG. 1 is a perspective view of a horse racing game apparatus according to the present invention.

FIG. 1 shows in perspective a horse racing game apparatus 1 according to the present invention.

As shown in FIG. 1, the horse racing game apparatus 1 generally comprises a central table 11, a plurality of player's consoles 2, four disposed along each of two opposite longitudinal sides of the central table 11 and two disposed along one of two opposite transverse sides of the central table 11, a control console 30 disposed along the other transverse side of the central table 11, four corner blocks 12 disposed respectively at the corners of the central table 11, and a monitor assembly 6 supported above the central table 11 by four legs 6*a* that are mounted respectively on the corner blocks 12. The central table 11 has a game field 4 defined on its upper surface and supporting thereon a plurality of movable bodies H (see FIG. 12) that resemble racehorses, respectively. The player's consoles 2, the corner blocks 12, and the control console 30 are closely positioned around the central table 11 without any appreciable gaps or clearances therebetween, thereby making up an game board surrounding structure of aesthetically unified design.

The control console 30 houses a control system 3 (see FIG. 11) for controlling overall operation of the horse racing game apparatus 1.

The player's consoles 2 are attended by respective game players who bet medals on favorite movable bodies (racehorses) H that run in a horse race performed on the game field 4. Each of the player's consoles 2 has on its upper end a slanted surface which is progressively inclined upwardly toward the game field 4. The slanted surface supports thereon a horse display unit 21 positioned on the left-hand side as viewed from the game player facing the game field 4, the horse display unit 21 comprising a cathode-ray display tube with its screen covered with a transparent touch panel, a medal insertion area 22*a* positioned on the right-hand side remotely from the game player, a medal discharge area 22*b* positioned on the right-hand side closely to the game player, and a winner's lamp 22*c* positioned on the upper end of the slanted surface remotely from the game player.

The game player at each of the player's consoles 2 inserts a medal or medals into the medal insertion area 22*a*. The game player makes a bet on a horse race by inserting a medal or medals into the medal insertion area 22*a*.

The horse display unit 21 serves to display various items of information about racehorses (movable bodies) H that will run in a horse race on the game field 4, i.e., horse numbers, odds, past race achievements, etc. for the player to consider in laying a bet. When the player touches one or more of the displayed horse numbers and one or more of displayed bet types including "win", "place", "show", "daily double", "perfecta", "quiniela", and "trifecta", ticket information which comprises the selected information is entered through the touch panel into the control system 3 in the control console 30, thereby completing a bet. The game player can enter any number and any type of ticket information from the player's console 2 for one horse race, but is required to insert one medal to enter one piece of ticket information. When ticket information has been entered from at least one player's console 2 and a predetermined bet time has elapsed, a horse race composed of plural racehorses (movable bodies) H starts to be carried out on the game field 4 under the control of the control system 3.

When the result of a race agrees with the entered ticket information, as many medals as according to the odds corresponding to the ticket information are discharged from the medal discharge area 22*b*.

The corner blocks 13 support thereon respective loudspeakers 13 for reproducing various effect sounds and simulated announcements during and before and after races.

The motor assembly 6 has video monitors 6*b* for displaying actual horse races that have been imaged by video cameras to make horse race games look realistic.

The game field 4 defined on the upper surface of the central table 11 comprises an oval track 5, a central field 8 disposed centrally in the track 5 and having an oval outer edge held against the track 5, and a surrounding edge bank 7 extending along an outer peripheral edge of the track 5. An oval strip defined on the track 5 between the central field 8 and the edge bank 7 is used as race courses.

The track 5, which serves as a game board, comprises an oval plate of synthetic resin which is green in color. The track 5 has a slit 52 (see FIGS. 3 and 4) defined centrally therein which extends along the major longitudinal axis thereof. The track 5 includes two raised rails 51 that are higher than the remaining portion of the track 5 and extend along respective opposite edges of the slit 52.

Figure 3:
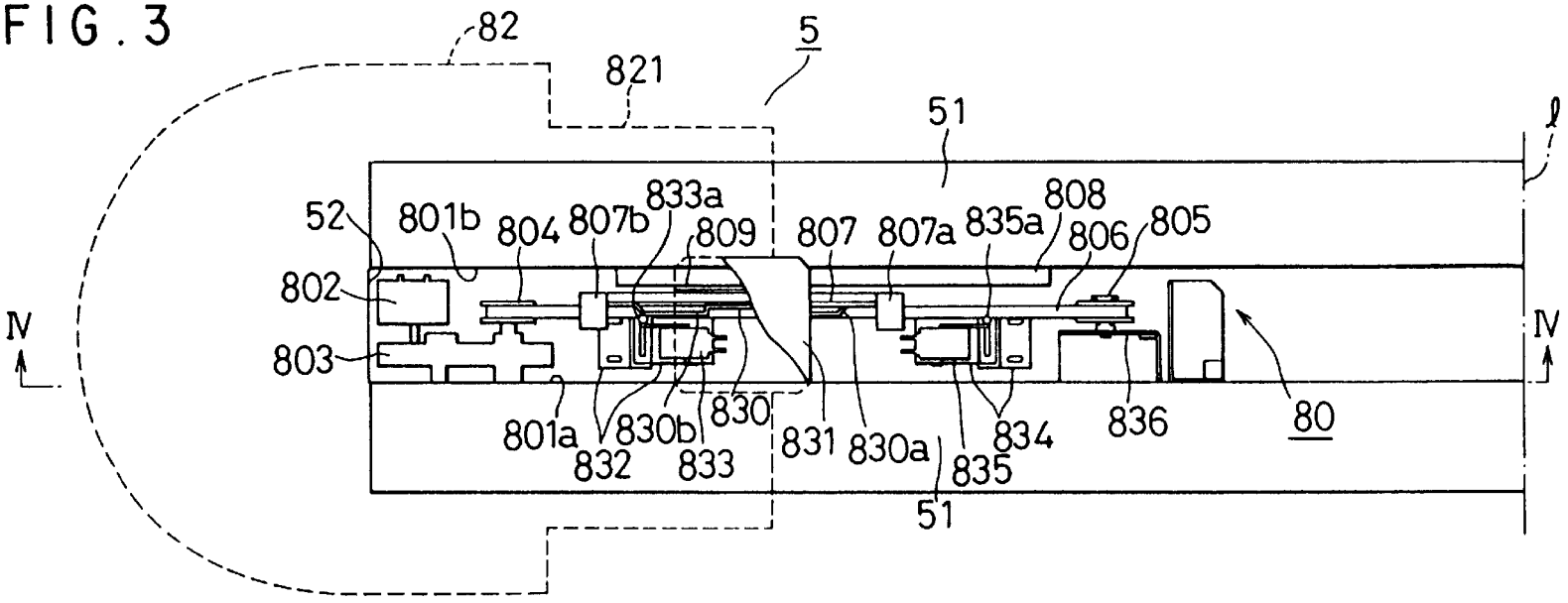
FIG. 3 is a plan view of an actuator mechanism for a movable portion of a central field.
Figure 4:
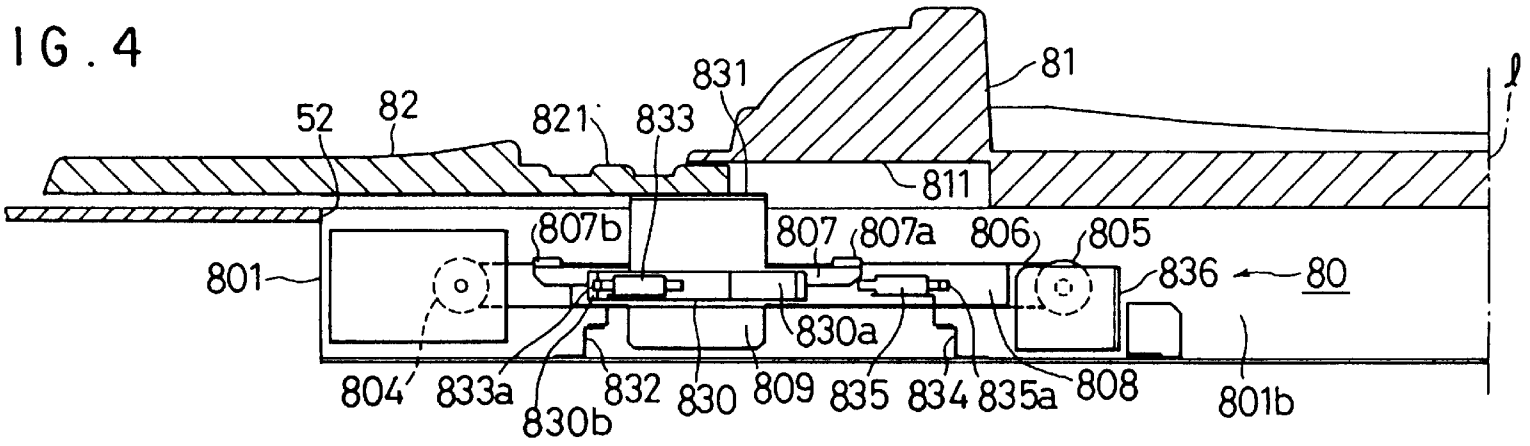
FIG. 4 is a cross-sectional view taken along line IV—IV of FIG. 3.

As shown in FIG. 4, the central field 8 has a central fixed member 81 fixedly disposed intermediate between the raised rails 51. The central field 8 also has a pair of spaced movable members 82 on its opposite ends that are slidably positioned near the respective opposite ends of the raised rails 51. In FIG. 3, the fixed member 81 is omitted from illustration, and one of the movable members 82 is shown by the imaginary lines. In FIG. 4, the fixed member 81 and one of the movable members 82 are illustrated in cross section. Since the rails 51, the slit 52, and the central field 8 are symmetrical in shape with respect to their transverse central axis, only a portion of the central field 8 on one side of the transverse axis is shown in FIGS. 3 and 4.

Figure 5:
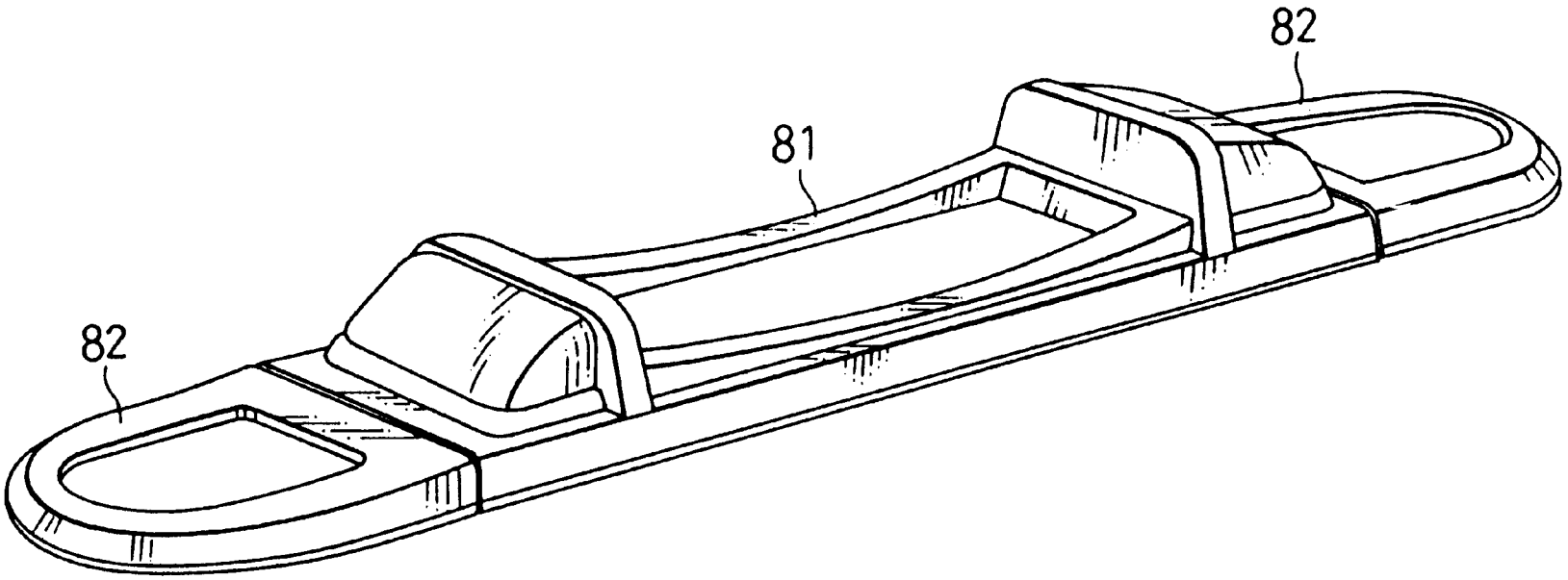
FIG. 5 is a perspective view of the central field as it is contracted.
Figure 6:
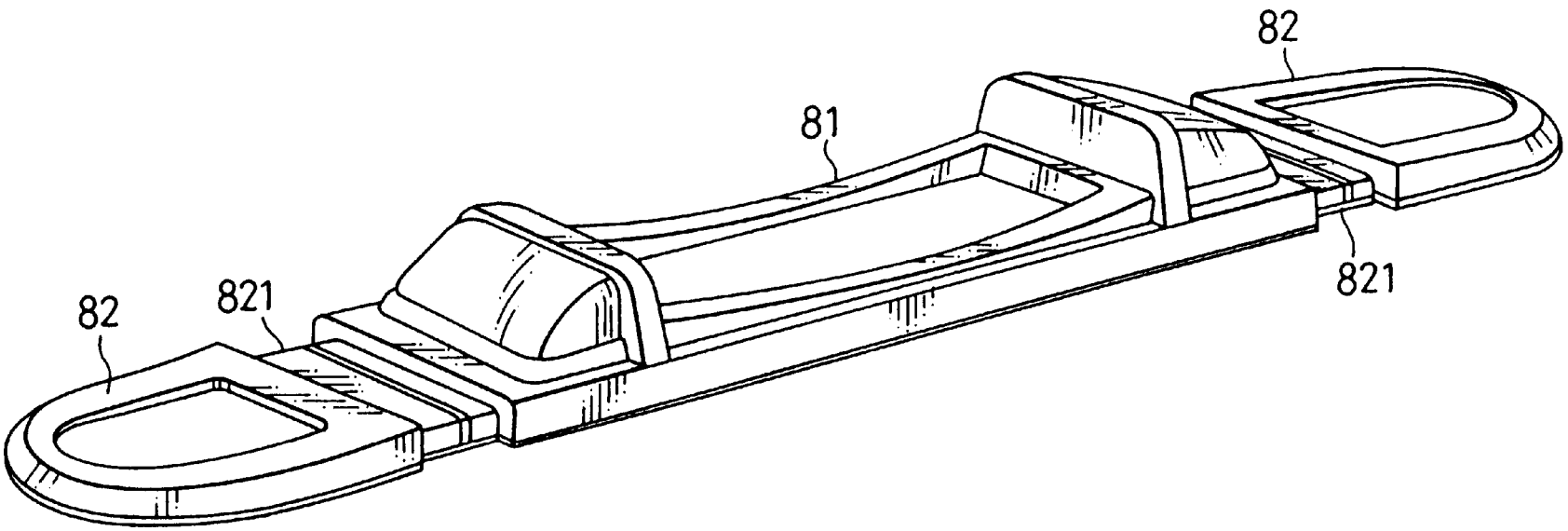
FIG. 6 is a perspective view of the central field as it is expanded.

As shown in FIGS. 3 and 4, each of the movable members 82 has an integral insert 821 of rectangular in shape as viewed in plan on an end thereof near the fixed member 81. The insert 821 is thinner and narrower than the remainder of the movable member 82. The fixed member 81 has a box-shaped gap 811 defined in the lower surface of each of its opposite ends for fully receiving the insert 821 of the movable member 82. Therefore, the insert 821 can be inserted into the gap 811. When the insert 821 is fully inserted in the gap 811, the central field 8 is most contracted in its longitudinal direction as shown in FIG. 5, and when the insert 821 is fully pulled out of the gap 811 as shown in FIG. 4, the central field 8 is most extended in its longitudinal direction as shown in FIG. 6.

The slit 52 in the track 5 houses two extending/contracting mechanisms 80 for moving the movable members 82 toward and away from each other. Since the extending/contracting mechanisms 80 are identical to each other, only one of the extending/contracting mechanisms 80 will be described below with reference to FIGS. 3 and 4.

An elongate box-shaped frame 801 having an upper opening that is identical in shape to the slit 52 is fixed in the slit 52. The upper opening of the frame 801 has an upper edge lying flush with the upper surface of the track 5.

A motor 802 is fixedly mounted in the frame 801 near one end thereof, i.e., a right-hand end as viewed in FIGS. 3 and 4. The motor 802 has a rotatable shaft extending transversely of the frame 801, i.e., vertically in FIG. 3 or in a direction normal to the sheet of FIG. 3. The rotatable shaft of the motor 302 is operatively coupled to a train of speed reduction gears in a gear box 803 that is fixed to an inner surface of the first side wall (lower side wall in FIG. 3) 801*a* of the frame 801. A drive pulley 804 which is rotatable by the motor 802 through the train of speed reduction gears is rotatably mounted on an outer surface of the gear box 803 parallel to the motor 802. On the inner surface of the first side wall 801*a* near a transverse central axis L of the frame 801, there is fixed a stay 836 on which a driven pulley 805 is rotatably supported with its rotatable shaft extending parallel to the transverse central axis L. The drive pulley 804 and the driven pulley 805 are rotatable in a common vertical plane and positioned at the same height. A drive belt 806 is trained around the drive pulley 804 and the driven pulley 805 and has opposite ends fixed respectively to belt fixtures 807*a*, 807*b* attached to respective opposite ends of a belt coupling 807 while the drive belt 806 is kept under tension. The drive belt 806 and the belt coupling 807 jointly make up an loop for rotating the drive and driven pulleys 804, 805 in unison with each other. A microswitch trigger member 830 is fixed to a side of the belt coupling 807 which faces the first side wall 801*a*, the microswitch trigger member 830 being bent to provide raised end portions 830*a*, 830*b*.

A slide rail 808 is attached to an inner surface of the second side wall 801*b* of the frame 801 parallel to the drive belt 806. The slide rail 808 is positioned at the same height as the drive and driven pulleys 804, 805. A slider 809 parallel to the second side wall 801*b* is slidably and unremovably mounted on the slide rail 808. The slider 809 has an upper end projecting upwardly through the slit 52 a certain distance from the surface of the track 5. A attachment 831 which is of a substantially square shape and fixed to a lower surface of the movable member 82 of the central field 8 is fixed to the upper end of the slider 809 and extends parallel to the surface of the track 5. Therefore, the lower surface of the movable member 82 is lifted off the surface of the track 5 by a distance that is equal to the distance by which the upper end of the slider 809 projects upwardly from the surface of the track 5.

The slider 809 is securely coupled to the belt coupling 807. Therefore, when the motor 802 is energized, the rotation of the rotatable shaft thereof is transmitted through the train of speed reduction gears in the gear box 803 to the drive pulley 804. When the drive pulley 804 is rotated, the belt coupling 803 is moved between the drive and driven pulleys 804, 805 by the drive belt 806 that is trained around the drive and driven pulleys 804, 805. The belt coupling 803 displaces the slider 809 fixed thereto along the slide rail 808. As a consequence, the movable member 82 secured to the attachment 831 moves along the major longitudinal axis of the central table 11.

A maximally extended position detecting microswitch (detecting device) 833 is fixed to the bottom of the frame 801 by a stay 832. The maximally extended position detecting microswitch 833 can be actuated when a detector arm 833*a* thereof contacts the raised end portion 830*b* of the microswitch trigger member 830 when the movable member 82 moves to the maximally extended position shown in FIG. 6. Similarly, a maximally contracted position detecting microswitch (detecting device) 835 is fixed to the bottom of the frame 801 by a stay 834. The maximally contracted position detecting microswitch 835 can be actuated when a detector arm 835*a* thereof contacts the raised end portion 830*a* of the microswitch trigger member 830 when the movable member 82 moves to the maximally contracted position shown in FIG. 5. When the microswitches 833, 835 are actuated, the control system 3 controls the motor 802 to stop its rotation in one direction and to be reversed only.

Figure 2:
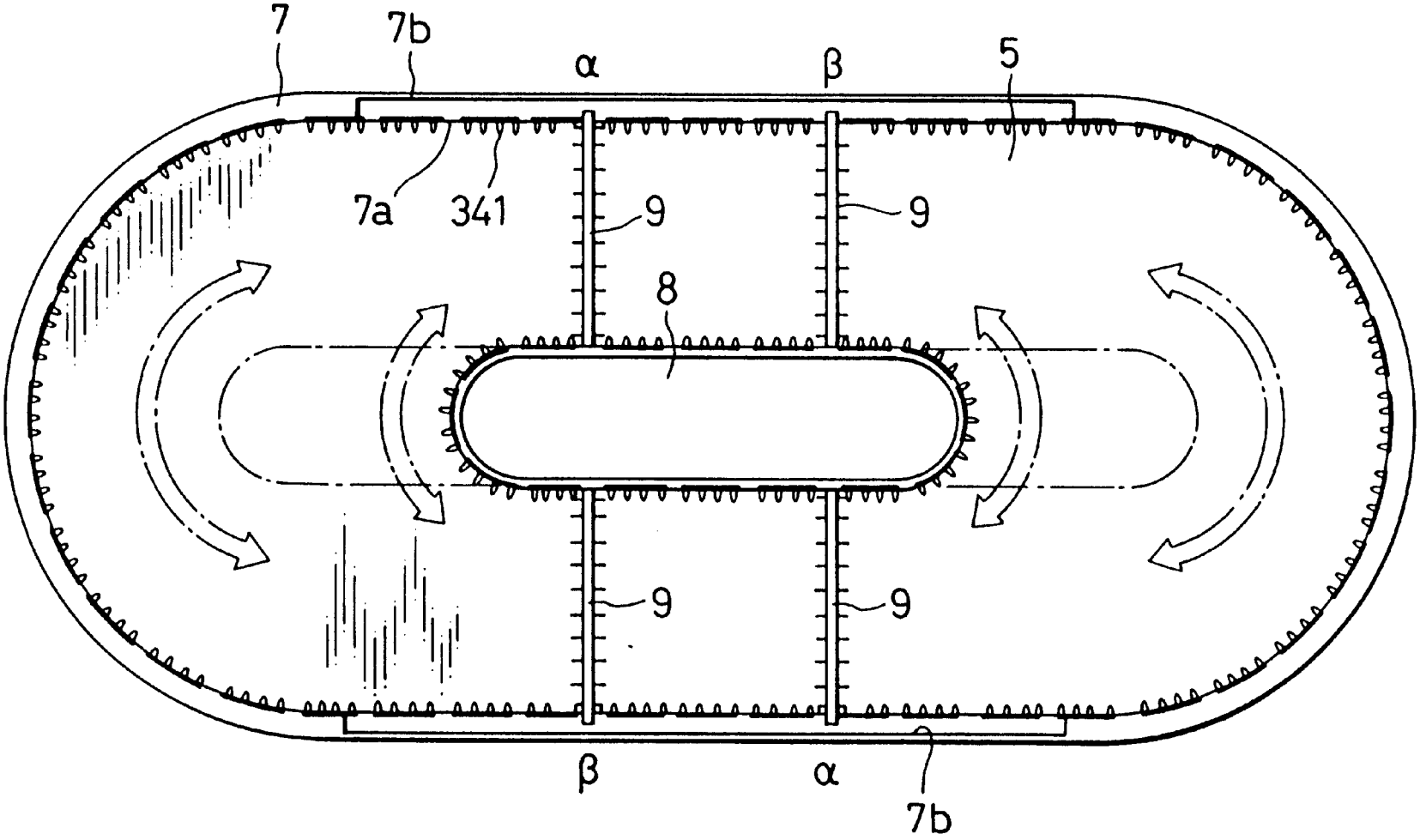
FIG. 2 is a plan view of a game board of the horse racing game apparatus shown in FIG. 1.

As shown in FIG. 2, the edge bank 7 has an inner wall 7*a* raised along the outer edge of the track 5, the inner wall 7*a* having an outer side defined as a surface higher than the surface of the track 5. The inner wall 7*a* of the edge bank 7 is of an oval shape having such a size that the inner wall 7*a* and the outer edge of the central field 8 define therebetween race courses of certain width when the central field 8 is in the maximally extended position as shown in FIG. 6.

The outer side of the inner wall 7*a* which extends along a straight stretch of the race courses has a pair of slits 7*b* parallel to the inner wall 7*a*, as shown in FIG. 1. Each of the slits 7*b* houses therein a holder 91 (see FIGS. 7 and 8) on which an end of the start gate 9, and a moving mechanism 90 for sliding the holder 91 along the straight stretch of the race courses.

The moving mechanism 90, the holder 91, and the start gate 9 in each of the slits 7*b* will be described below.

Figure 7:
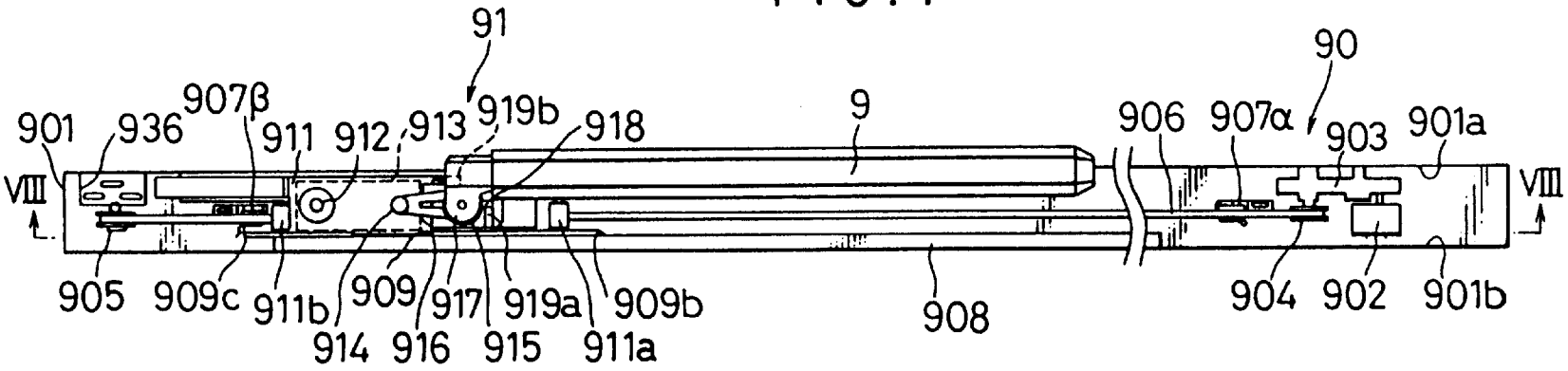
FIG. 7 is a plan view of mechanisms for rotating and moving a start gate.
Figure 8:
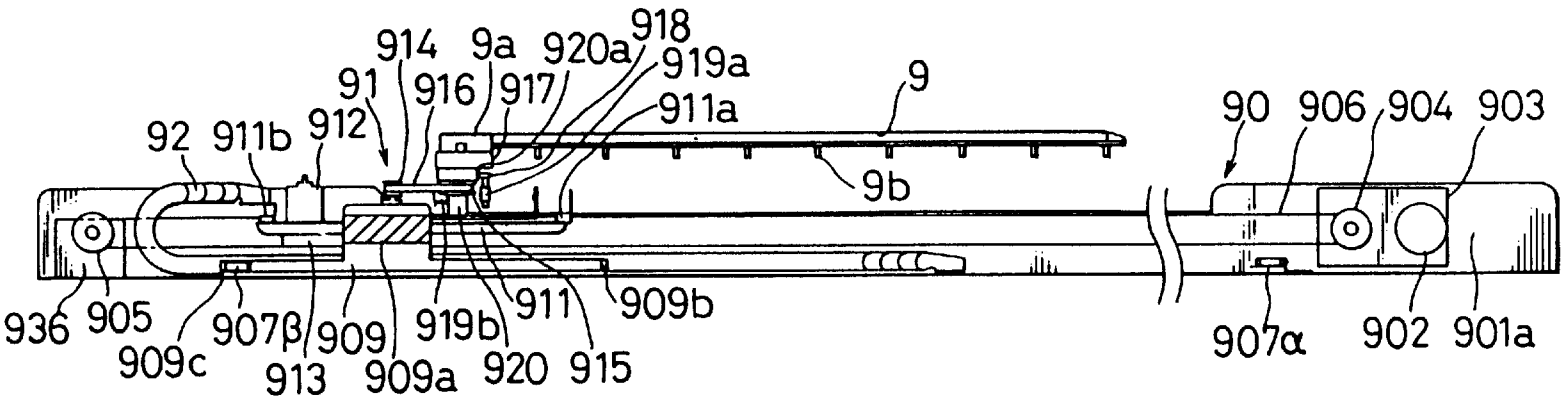
FIG. 8 is a cross-sectional view taken along line VIII—VIII of FIG. 7.

An elongate box-shaped frame 901 having an upper opening that is identical in shape to the slit 7*b* is fixed in the slit 7*b*. The upper opening of the frame 901 has an upper edge lying flush with the upper surface of the edge bank 7. FIGS. 7 and 8 only show mechanical structures mounted on the frame 901.

As shown in FIGS. 7 and 8, a motor 902 is fixedly mounted in the frame 901 near one end thereof, i.e., a right-hand end as viewed in FIGS. 7 and 8. The motor 902 has a rotatable shaft extending transversely of the frame 901, i.e., vertically in FIG. 7 or in a direction normal to the sheet of FIG. 8. The rotatable shaft of the motor 902 is operatively coupled to a train of speed reduction gears in a gear box 903 that is fixed to an inner surface of a first side wall (an upper side wall in FIG. 3 which faces the track 5) 901*a* of the frame 901. A drive pulley 904 which is rotatable by the motor 902 through the train of speed reduction gears is rotatably mounted on an outer surface of the gear box 903 parallel to the motor 902. On the inner surface of the first side wall 901*a* near an opposite end of the frame 901, there is fixed a stay 936 on which a driven pulley 905 is rotatably supported with its rotatable shaft extending transversely of the frame 901. The drive pulley 904 and the driven pulley 905 are rotatable in a common vertical plane and positioned at the same height. A drive belt 906 is trained around the drive pulley 904 and the driven pulley 905 and has opposite ends fixed respectively to belt fixtures 911*a*, 911*b* attached to respective opposite ends of a movable base 911 while the drive belt 906 is kept under tension. The drive belt 906 and the movable base 911 jointly make up an loop for rotating the drive and driven pulleys 904, 905 in unison with each other.

A slide rail 908 is attached to an inner surface of a second side wall 901*b* of the frame 901 parallel to the drive belt 906. The slide rail 908 is positioned at the same height as the drive and driven pulleys 904, 905. A slider 909 disposed parallel to the second side wall 801*b* has a slidable ridge 909*a* slidably, but unremovably, mounted on the slide rail 908. The slider 909 also has a pair of microswitch trigger members 909*b*, 909*c* extending longitudinally of the frame 901 and integral with respective lower corners of the slider 909.

The slider 909 is securely coupled to the movable base 911. Therefore, when the motor 902 is energized, the rotation of the rotatable shaft thereof is transmitted through the train of speed reduction gears in the gear box 903 to the drive pulley 904. When the drive pulley 904 is rotated, the movable base 911 is moved along the slide rail 908 between the drive and driven pulleys 904, 905 by the drive belt 906 that is trained around the drive and driven pulleys 904, 905.

A stroke limit detecting microswitch (detecting device) 907α is fixed to the bottom of the frame 901 near its one end. The stroke limit detecting microswitch 907α can be actuated upon contact with the microswitch trigger member 909*b* when the start gate 9 moves to a position α shown in FIG. 2. Similarly, a stroke limit detecting microswitch (detecting device) 907β is fixed to the bottom of the frame 901 near its opposite end. The stroke limit detecting microswitch 907β can be actuated upon contact with the microswitch trigger member 909*c* when the start gate 9 moves to a position β shown in FIG. 2. When the microswitches 907α, 907β are actuated, the control system 3 controls the motor 902 to stop its rotation in one direction and to be reversed only.

The movable base 911, which is part of the holder 91, is in the form of a planar member which is rectangular in shape as viewed in plan. A motor 912 which has a rotatable shaft extending vertically as viewed in FIG. 8 is fixedly mounted on the upper surface of an end of the movable base 911 closer to the driven pulley 905. The rotatable shaft of the motor 912 extends through the movable base 911 and is operatively coupled to a train of speed reduction gears in a gear box 913 that is fixed to a lower surface of the movable base 911. The train of speed reduction gears has an output shaft extending through the movable base 911 and having a tip end connected to a drive pulley 914 which is rotatably mounted substantially centrally on the movable base 911. The drive pulley 914 has a rotatable shaft extending vertically.

A vertical start gate support shaft 920 is rotatably mounted on the upper surface of an opposite end of the movable base 911 which is closer to the drive pulley 904. A driven pulley 915, which is larger in diameter than the drive pulley 914, is attached to the start gate support shaft 920 at the same height as the drive pulley 914. An endless drive belt 916 is trained around the drive pulley 914 and the driven pulley 915 for transmitting the rotation of the drive pulley 914, as reduced in speed by the gear box 913, to the start gate support shaft 920.

The start gate support shaft 920 has on its upper end a large-diameter portion 920*a* which is slightly large in diameter than the driven pulley 915. A joint 917, which is substantially L-shaped in plan, has an end fixed to the tip end of the large-diameter portion 920*a*. The start gate 9 has a proximal end 9*a* fixed to the other end of the joint 917. The start gate 9 comprises an elongate planar bar and has nine spaced frame plates 9*b* mounted on a lower surface thereof. The frame plates 9*b* define eight start frames for the respective racehorses (movable bodies) H.

Figure 9:
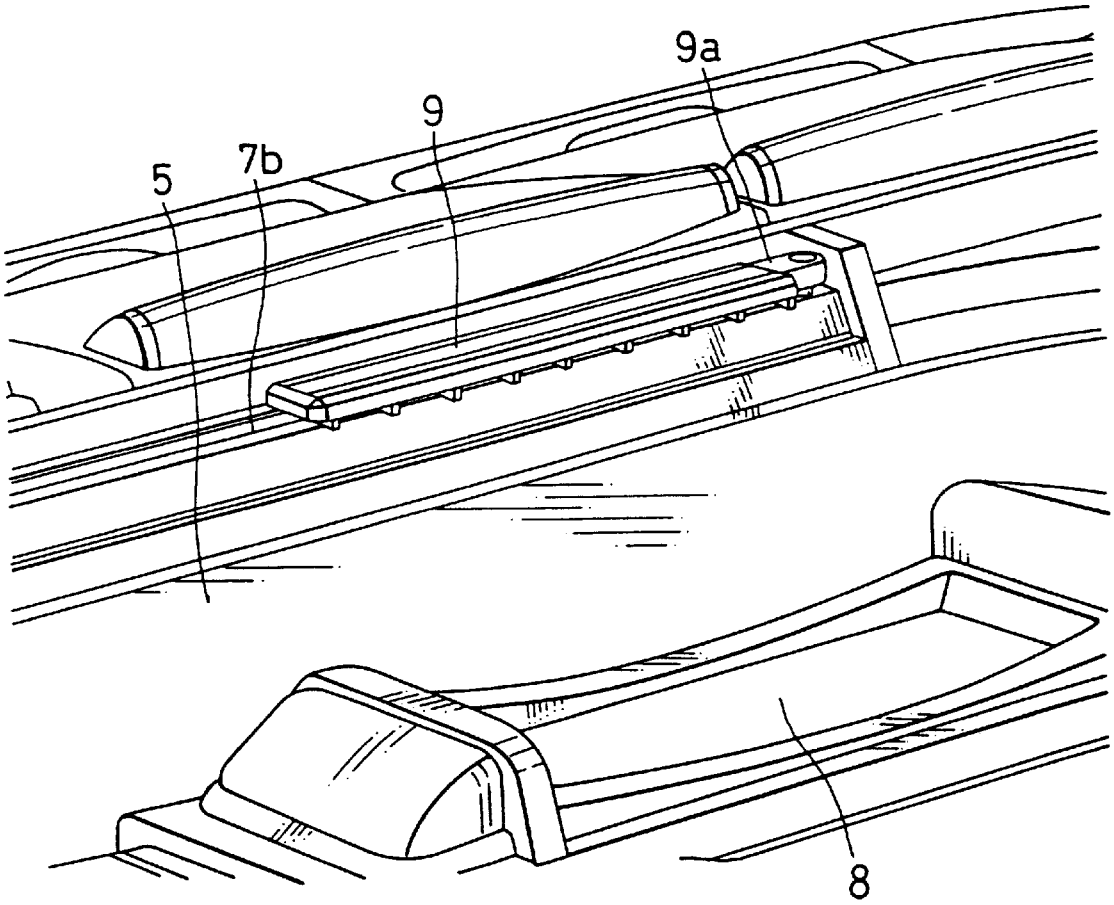
FIG. 9 is a perspective view of the start gate as it is retracted.
Figure 10:
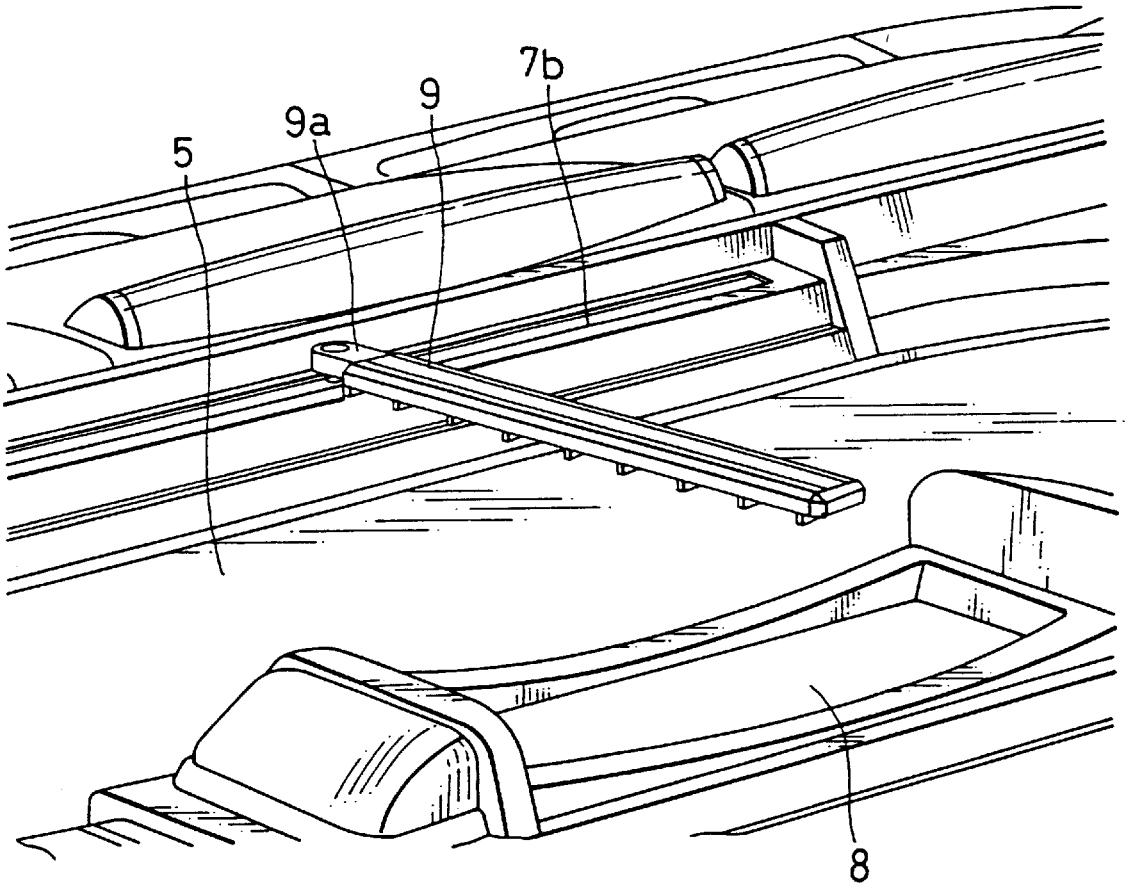
FIG. 10 is a perspective view of the start gate as it is set in position.

When the motor 912 is energized, the rotation of the rotatable shaft thereof is transmitted through the train of speed reduction gears in the gear box 913 to the drive pulley 914. When the drive pulley 914 is rotated, the start gate support shaft 920 is angularly moved by the drive belt 916 that is trained around the drive and driven pulleys 914, 915. The start gate 9 which is connected in offset relation to the start gate support shaft 920 by the joint 917 is angularly moved about the start gate support shaft 920. The large-diameter portion 920*a* has a tooth 918 mounted on a circumferential surface thereof. A retracted position detecting microswitch 919*a* which is fixedly mounted on an upper surface of the movable base 911 is actuated upon contact with the tooth 918 when the start gate 9 is angularly moved to a retracted position parallel to the slit 7*b* as shown in FIGS. 7 through 9. Similarly, a set position detecting microswitch 919*b* which is fixedly mounted on an upper surface of the movable base 911 is actuated upon contact with the tooth 918 when the start gate 9 is angularly moved to a set position perpendicular to the slit 7*b* as shown in FIG. 10. When the microswitches 919*a*, 919*b* are actuated, the control system 3 controls the motor 912 to stop its rotation in one direction and to be reversed only.

As shown in FIG. 8, a cable conduit 92 which comprises a number of articulated sheaths so as to be flexible in one direction has an end attached to the upper end of the movable base 911 at an edge closer to the drive pulley 905. The cable conduit 92 extends from the movable base 911 toward the drive pulley 905, is turned 180°, then extends on the bottom of the frame 901 toward a center of the frame 901 where the opposite end of the cable conduit 92 is fixed to the bottom of the frame 901. The cable conduit 92 houses electric wires by which the control system 3 and the motor 912 are electrically connected. Therefore, no matter where the movable base 911 may be positioned in its stroke, electric energy can be supplied to the motor 912 by electric wires, and the cable conduit 92 is prevented from being stuck or twisted in the frame 901.

Figure 11:
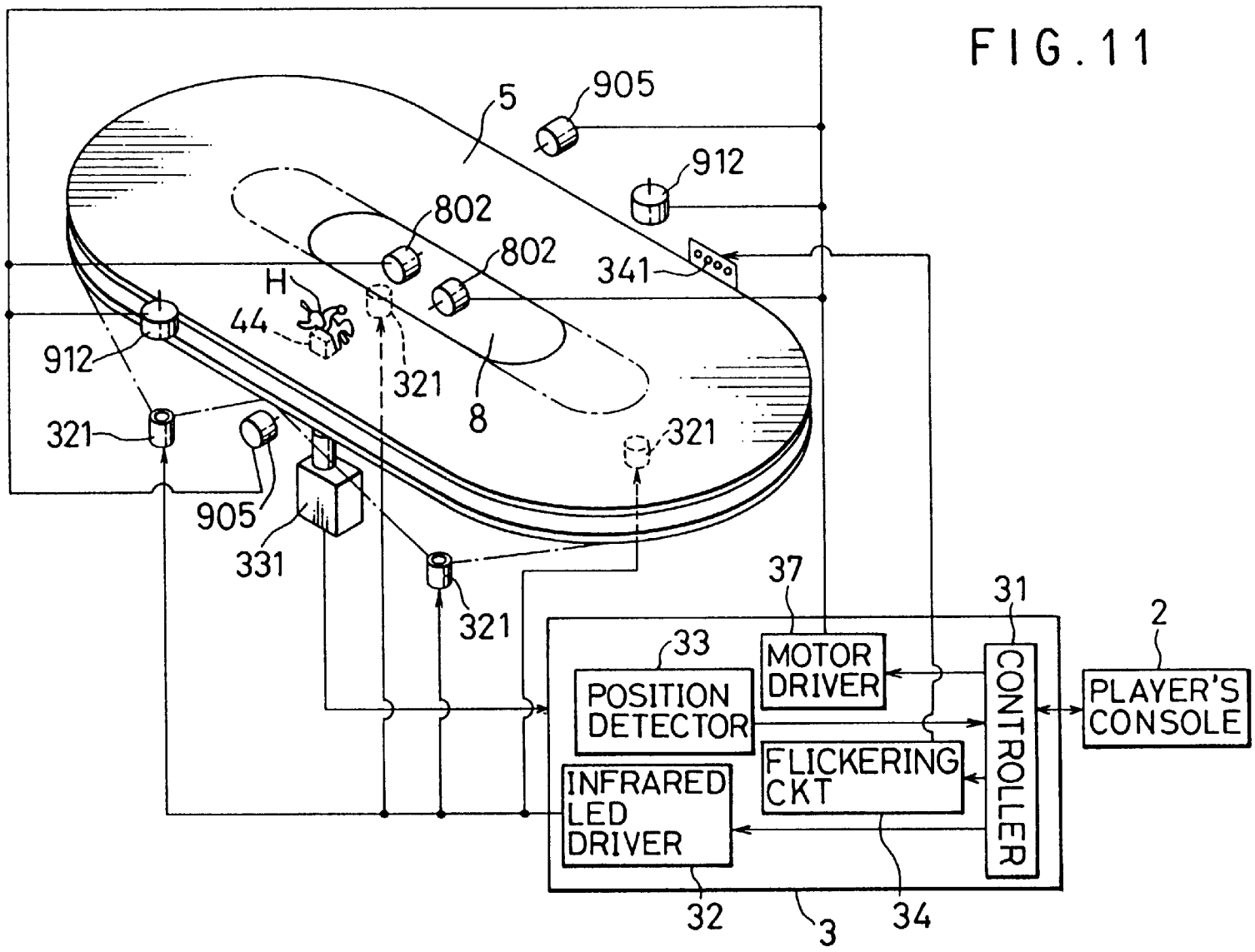
FIG. 11 is a block diagram of a control system of the horse racing game apparatus.

As shown in FIG. 11, the motors 802, 905, 912 are electrically connected to a motor driver 37 in the control system 3. Based on selected course information entered from a controller 31, the motor driver 37 selectively energizes the motors 802, 905, 912 to establish race courses. Specifically, as shown in FIG. 2, the motor driver 37 may energize the motors 802 to move the movable members 82 to establish either short-distance race courses by retracting the movable members 82 into the fixed member 81 to contract the central field 8 as shown in the solid lines in FIG. 2, or long-distance race courses by pulling the movable members 82 out of the fixed member 81 to extend the central field 8 as shown in the broken lines in FIG. 2. The motor driver 37 may energize either one of the motors 912 to set an upper start gate (first start gate) 9 as viewed in FIG. 2 or a lower start gate (second start gate) 9 as viewed in FIG. 2 over the track 5, and may also energize the corresponding motor 905 to move the set start gate 9 to α position a or a position β. Therefore, there are available a total of four start gate positions as shown in FIG. 2. Consequently, the motor driver 7 can arrange a total of 8 race course selections. The controller 31 in the control system 3, which serves as a central processing unit for controlling overall operation of the horse racing game apparatus 1, can establish either a clockwise direction or a counterclockwise direction in which the race horses (movable bodies) H run along the track 5. As a result, the horse racing game apparatus 1 can provide a total of 16 race course selections for simulated horse races.

As shown in FIGS. 2 and 11, a number of lightemitting elements 341 such as light-emitting diodes are mounted on an outer circumferential surface of the track 5, i.e., the inner wall 7*a* of the edge bank 7, and an inner circumferential surface of the track 5, i.e., the outer circumferential edge of the central field 8. The lightemitting elements 341 are selectively turned on to indicate a goal by a flickering circuit 34 that is controlled by the controller 31.

An arrangement for moving the race horses (movable bodies) H on the track 5 will be described below.

In the illustrated embodiment, the start gate 9 has a total of 8 frames for race horses (movable bodies) H, and 8 race horses (movable bodies) H are placed on the track 5. Serial horse numbers are assigned to the respective race horses (movable bodies) H. The horse numbers can be established by setting 4-bit DIP switches on self-propelled vehicles 44 (described later on) of the respective race horses (movable bodies) H.

Figure 12:
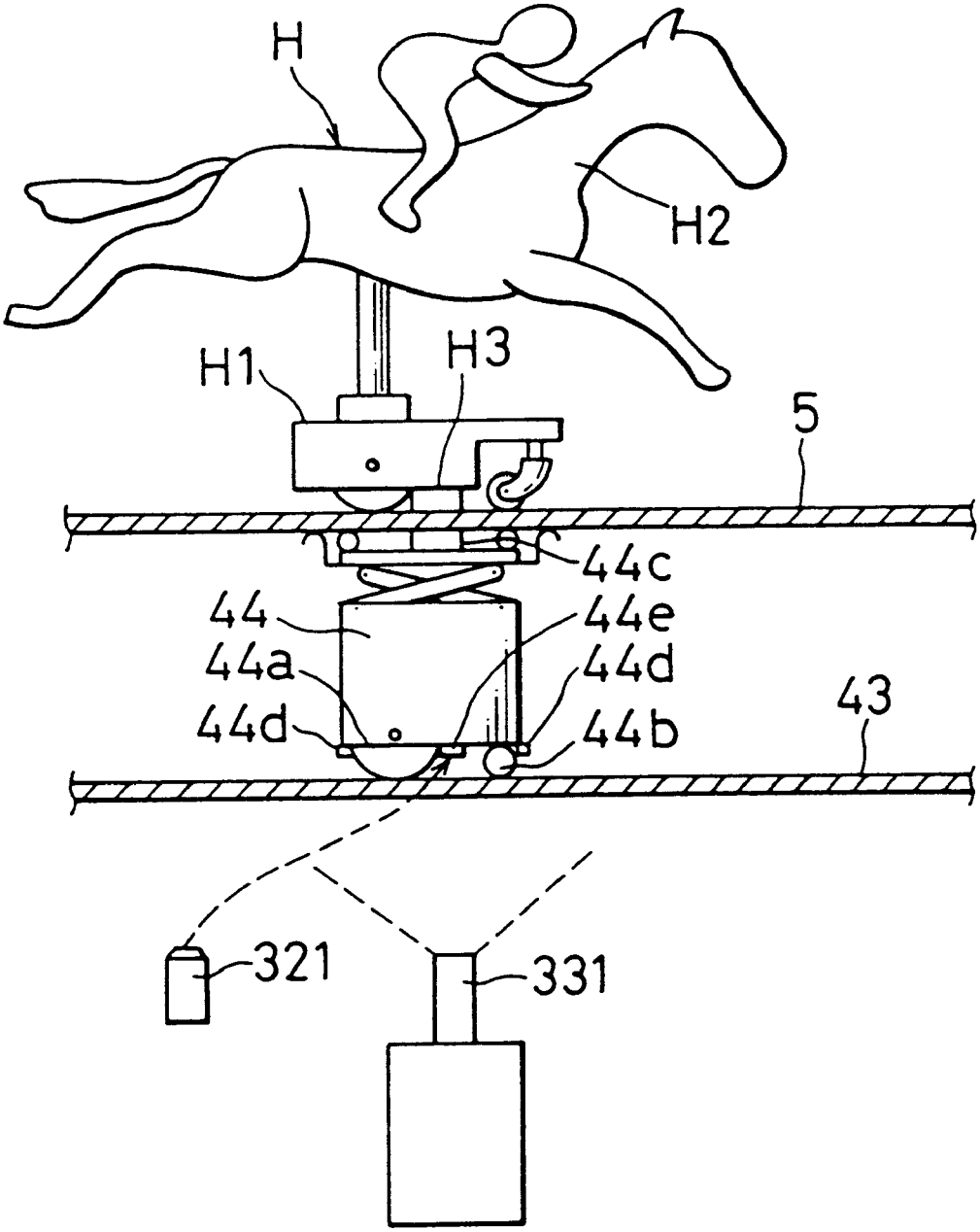
FIG. 12 is a side elevational view, partly in cross section, of a mechanism for moving a racehorse.

FIG. 12 schematically shows a mechanism for moving each of the race horses (movable bodies) H. As shown in FIGS. 11 and 12, a base plate 43 of transparent synthetic resin underlies the track 5 parallel thereto, with each of the self-propelled vehicles 44 being disposed in a space defined between the upper surface of the base plate 43 and the track 5. Positive and negatives square-shaped electrodes that are out of phase with each other by 90° are disposed adjacent to each other on the lower surface of the track 5.

As shown in FIG. 12, each of the self-propelled vehicles 44 has a plurality of electrode pins disposed on an upper surface thereof along one radial line and normally biased to project upwardly. At least one of the electrode pins is held in sliding contact with each of the positive and negatives square-shaped electrodes on the lower surface of the track 5. The self-propelled vehicle 44 also has a propulsion motor (not shown) energizable by electric energy supplied from the electrode pins held in sliding contact with the positive and negatives square-shaped electrodes, a pair of transversely spaced drive wheels 44*a* rotatable by the propulsion motor, and a driven wheel 44*b* positioned ahead of the drive wheels 44*a*, i.e., to the right of the drive wheels 44*a* as viewed in FIG. 12. The self-propelled vehicle 44 can make a right turn or a left turn when the drive wheels 44*a* rotate at different speeds, and can run straight when the drive wheels 44*a* rotate at the same speed. The self-propelled vehicle 44 can change its speed of travel by changing the speed of rotation of the drive wheels 44*a*. The self-propelled vehicle 44 has on its upper surface an X-shaped linkage and a resilient member for normally biasing the X-shaped linkage upwardly. Rollers are mounted on the X-shaped linkage for limiting the vertical spacing between the lower surface of the track 5 and the X-shaped linkage, and a magnet 44*c* is fixedly mounted on the X-shaped linkage so as to be slightly spaced from the lower surface of the track 5.

The race horse (movable body) H comprises a chassis H1 and a horse model H2 fixedly mounted on the chassis H1 by a vertical support rod. The chassis H1 has wheels on its lower surface. A magnet H3 is also mounted on the lower surface of the chassis H1 in vertical alignment with the magnet 44*c*, and has a maggnetic pole which faces an unlike magnetic pole of the magnet 44*c*. The race horse (movable body) H can thus move on the track 5 in order to follow movement of the self-propelled vehicle 44 on the track 5.

Light-emitting elements 44*d* are mounted on front and rear edges of the lower surface of the self-propelled vehicle 44. The front and rear light-emitting elements 44*d* can be turned on with a slight time difference to emit light rays which allow the race horse (movable body) H to be identified in position and direction. The light-emitting elements 44*d* of the respective self-propelled vehicles 44 are turned on successively with the sequence and timing depending on the horse numbers established by the DIP switches. By recognizing the sequence and timing, it is possible to recognize the present positions of the respective self-propelled vehicles 44, i.e., the race horses (movable bodies) H on the track 5. Light emitted from the lightemitting elements 44*d* is imaged by a CCD camera 331 which is positioned below the base plate 43 for capturing an image of the entire lower surface of the base plate 43.

The self-propelled vehicle 44 also has on its lower surface an infrared detector 44*e* for detecting an infrared radiation signal (control signal) emitted from a plurality of transmission LEDs 321 positioned below the base plate 43. A control signal detected by the infrared detector 44*e* is transmitted to a controller (not shown) in the self-propelled vehicle 44 to control operation of the self-propelled vehicle 44 with respect to the rotational speed of the propulsion motor and the speed difference between the drive wheels 44*a* for directional control.

A race carried out by the race horses (movable bodies) H on the track 5 is controlled by the control system 3. The control system 3 has a position detector 33 which detects the positions and directions of the respective race horses (movable bodies) H on the track 5 based on a detected signal which is generated by the CCD camera 331 that images the light-emitting elements 44*d* of the respective self-propelled vehicles 44. The detected positions and directions are supplied from the position detector 33 to the controller 31. Based on the supplied positions and directions, the controller 31 outputs a control signal to an infrared LED driver 32 according to a game program stored in a built-in ROM (not shown). The infrared LED driver 32 outputs the received control signal to the transmission LEDs 321. The control signal is associated with addresses representing the horse numbers of the respective race horses (movable bodies) H for individually controlling the race horses (movable bodies) H.

A simulated horse race performed by the horse racing game apparatus 1 will briefly be described below.

Depending on selected course information from the controller 31, the motor driver 37 establishes race courses, and the controller 31 determines the direction in which the race horses (movable bodies) H are to move along the track 5, the number of times that the race horses (movable bodies) H are to run around the track 5, and a goal position. The controller 31 then outputs a control signal through the transmission LEDs 321 to the race horses (movable bodies) H on the track 5 for thereby instructing the race horses (movable bodies) H to move into the respective frames of the start gate 9 which has been set over the track 5. The race horses (movable bodies) H now enter into the frames which correspond to their own horse numbers.

In response to a control signal indicative of the start of the race, the race horses (movable bodies) H start moving on the track 5. Immediately thereafter, the motor driver 37 reverses the motor 912 to move the start gate 9 from the set position back to the retracted position on the slit 5*b*. Movement of the race horses (movable bodies) H during the race is controlled according to speeds and instantaneous forces calculated by the controller 31 based on predetermined characteristic data (distribution functions as to standard speeds and instantaneous forces, peculiar properties of the race horses) of the race horses (movable bodies) H which have been stored in the controller 31 and also random numbers generated at given time intervals. When the race horses (movable bodies) H make a turn around a corner of the track 5, the controller 31 controls them so as to run around the corresponding movable member 82 of the central field 8 at that time. When the race horses (movable bodies) H thus controlled reach the goal, their results are indicated to the player's consoles 2 to discharge medals through the medal discharge area 22*b*.

As described above, the horse racing game apparatus 1 allows the central field 8 to be selectively extended and contracted in its longitudinal direction to change the inner circumferential length of the track 5, and also allows the start gate 9 to change its position. The horse racing game apparatus 1 is relatively simple in structure and small in size, but is capable of arranging a wide variety of race course selections.

Since the start gate 9 which is indicative of a start position for race courses is movable along the race courses, the horse racing game apparatus 1 can arrange a wide variety of race course selections with a relatively simple structure.

Although certain preferred embodiments of the present invention have been shown and described in detail, it should be understood that various changes and modifications may be made therein without departing from the scope of the appended claims.

What is claimed is:

1. A racing game apparatus comprising:

a game board with race courses established thereon;

a plurality of movable bodies movable along said race courses for ranks;

a central field mounted on said game board and defining an inner circumferential path for the race courses, said central field being selectively extensible and contractible in at least one direction; and a mechanism for selectively extending and contracting said central field;

said central field comprising at least two members, one of said members being movable into and out of the other of said members.

2. A racing game apparatus according to claim 1, wherein said central field has an oval outer edge held against said game board.

3. A racing game apparatus 1, comprising:

a game board with race courses established thereon;

a plurality of movable bodies movable along said race courses for ranks;

a central field mounted on said game board and defining an inner circumferential path for the race courses, said central field being selectively extensible and contractible in at least one direction; and a mechanism for selectively extending and contracting said central field;

said central field comprising a central fixed member fixed to said game board; and a pair of movable members on opposite ends of said central fixed member and movable toward and away from said central fixed member.

4. A racing game apparatus according to claim 3, wherein said mechanism comprises a mechanism for moving said movable members.

5. A racing game apparatus according to claim 4, wherein said mechanism comprises:

a detector for detecting said movable members in each of said predetermined positions; and an actuator for moving said movable members until said detector detects said movable members in each of said predetermined positions.

6. A racing game apparatus according to claim 5, wherein said detector comprises a microswitch.

7. A racing game apparatus according to claim 4, wherein said mechanism comprises a mechanism for moving said movable members to a plurality of predetermined positions.

8. A racing game apparatus according to claim 7 or 5 wherein said plurality of predetermined positions include a first position close to said fixed member and a second position remote from said fixed member.

9. A racing game apparatus comprising:

a game board with race courses established thereon;

a plurality of movable bodies movable along said race courses for ranks;

a bar-shaped start position indicator for indicating a start position for the race courses;

a holder for holding said bar-shaped start position indicator for displacement between a first position in which said bar-shaped start position indicator lies over and across said race courses and a second position in which said bar-shaped start position indicator is retracted away from said race courses; and a mechanism for moving said holder along said race courses.

10. A racing game apparatus according to claim 9, comprising a plurality of said bar-shaped start position indicators, a plurality of said holders, and a plurality of said mechanisms, said first position being occupiable by only either one of said bar-shaped start position indicators.

11. A racing game apparatus according to any one of claims 9 and 10, further comprising:

a central field mounted on said game board and defining an inner circumferential path for the race courses, said central field being selectively extensible and contractable in at least one direction; and a mechanism for selectively extending and contracting said central field.

12. A racing game apparatus according to claim 9, wherein said mechanism comprises a mechanism for moving said holder to a plurality of predetermined positions.

13. A racing game apparatus according to claim 12, wherein said mechanism comprises:

a detector for detecting said holder in each of said predetermined positions; and an actuator for moving said movable members until said detector detects said holder in each of said predetermined positions.

14. A racing game apparatus according to claim 13, wherein said detector comprises a microswitch.

15. A racing game apparatus according to claim 12, wherein said plurality of predetermined positions include two positions.

16. A racing game apparatus comprising:

a game board having a track;

a plurality of movable bodies movable along said track;

a start position member having a first start position on said track;

a holder for holding said start position member in said first start position; and a mechanism for moving said holder along said track to thereby effect movement of said start position member from said first start position to a second start position on said track.

17. A racing game apparatus according to claim 16 wherein said start position member overlies said track when in said first start position.

18. A racing game apparatus comprising:

a game board having a track;

a plurality of movable bodies movable along said track;

boundary parts on said game board defining a boundary for said track;

a first mechanism for selectively moving at least one of said boundary parts relative to said track to thereby selectively extend and contract said track;

a start position device having a first start position on said track; and a second mechanism for moving said start position device along said track from said first start position to another start position on said track.

19. A racing game apparatus comprising:

a game board having a track;

a plurality of movable bodies movable along said track;

first means for providing a first start position on said track; and second means for moving said first start means along said track such that said first start means provides a second start position on said track spaced from said first start position.

20. A racing game comprising:

a game board having a track, said track having at least one generally straight path portion bounded by inner and outer walls;

a plurality of movable bodies movable along said track;

a start position member for indicating a start position for the racing game;

a holder for holding said start position member for displacement between a first position in which said start position member overlies said track and a second position in which said start position member is displaced from said first position, said start position member being generally parallel to at least one of said inner and outer walls when said start position member is in said second position; and a mechanism for moving said holder between said first and second positions.

* * * * *